United States Patent [19]

Foster, Jr. et al.

[11] Patent Number: 4,711,177

[45] Date of Patent: Dec. 8, 1987

[54] AUXILIARY BOOSTER

[75] Inventors: Joseph C. Foster, Jr., Ft. Walton Beach; Andrew G. Bilek, Valparaiso, both of Fla.

[73] Assignee: The United States of America as represented by the Secretary of the Air Force, Washington, D.C.

[21] Appl. No.: 893,846

[22] Filed: Aug. 6, 1986

[51] Int. Cl.[4] ..... F42C 19/08

[52] U.S. Cl. ..... 102/204

[58] Field of Search ..... 102/204, 318, 317, 202.5

[56] References Cited

U.S. PATENT DOCUMENTS

| | | | |
|---|---|---|---|
| 2,764,092 | 9/1956 | Massey | 102/204 |
| 3,499,386 | 3/1970 | Stadler et al. | 102/86.5 |
| 3,611,939 | 10/1971 | Stadler et al. | 102/46 |
| 3,688,702 | 9/1972 | Prior et al. | 102/204 |
| 4,421,030 | 12/1983 | DeKoker | 102/204 |
| 4,429,632 | 2/1984 | Yunan | 102/202.13 |
| 4,441,427 | 4/1984 | Barrett | 102/204 |
| 4,488,490 | 12/1984 | Betts | 102/513 |
| 4,541,342 | 9/1985 | Routledge | 102/204 |

*Primary Examiner*—Charles T. Jordan

*Attorney, Agent, or Firm*—William G. Auton; Donald J. Singer

[57] ABSTRACT

An auxiliary booster is used to relay and amplify the detonation wave from a standard configured bomb. An explosive system is placed in an extended fuse well to interface with the main charge. The auxiliary booster is initiated as a second, sequential event by this conventional booster charge. Energy of the conventional booster is transmitted into the auxiliary booster charge and the combined energy of the two charges is focused on the auxiliary charge's tapered metal liner. This tapered metal liner is driven through an air gap into the end of the fuse well at hypervelocity. The design of the device provides controlled packaging of energy for the generation of vaporific effects resulting in the collision of the metal liner of the auxiliary charge with the metallic end of the fuse well for enhanced detonation of the main charge.

6 Claims, 2 Drawing Figures

AUXILIARY BOOSTER

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to explosives, pyrotechnics and detonators, and more specifically to a detonation system which includes one or more auxiliary booster charges to enhance the ignition of a main charge by amplifying the detonation wave of an exploding booster charge.

Since the time of Nobel, great progress has been made in the development of explosives, propellants and pyrotechnics. Tomorrow the arsenal of the U.S. Air Force will include insensitive high explosives (IHE) as part of its tactical weaponry.

The Mark-80 series of bombs is an example of a proposed insensitive high explosive device. Its main charge, currently composed of tritonal, will be replaced by an insensitive high explosive having a relatively high threshold of shock needed to ignite it. Such explosives rely on an initial detonation of a booster charge to ignite the main charge.

When the booster of a high explosive bomb is detonated, the booster charge is transformed in less than 0.0002 second to a very hot gas. This gas momentarily occupies only the volume of the solid explosive, and consequently develops enormous pressure (about 100 tons per square inches for TNT). The gases expand in a detonation wave which is intended to ignite the IHE main charge of the explosive.

While the system of detonation described above is excellent in principle, the standard booster charge alone has not been a reliable means of initiating a steady state detonation of an insensitive high explosive main charge.

From the foregoing discussion, it is apparent that there currently exists the need for an explosive booster system which initiates steady state detonation in relatively insensitive explosives. The present invention is intended to satisfy that need.

SUMMARY OF THE INVENTION

The present invention is a detonation system which combines one or more auxiliary booster charges to relay and amplify the detonation wave of a standard booster charge to insure the proper detonation of the main charge.

One embodiment of the present invention adds an auxiliary booster charge to the fuse well between the conventional standard booster charge and the main charge of a 500 pound bomb of the Mark-80 series. The auxiliary booster charge includes a tapered metal liner to promote the detonation of the main charge as described below.

In operation the auxiliary booster charge is ignited by the detonation of the standard booster charge, and its detonation is initiated as a second sequential event. The combined energy of the exploding standard booster charge and the auxiliary booster charge is focused on the tapered metal liner of the auxiliary charge. The tapered metal liner is driven with hypervelocity into the end of the fuse well to provide controlled packaging of energy for initiating ignition of the main charge. This ignition is enhanced by the generation of vaporific effects as the tapered liner is driven into the metallic end of the fuse well.

It is an object of the present invention to provide a means of enhancing the detonation of explosives, including insensitive high explosives.

It is another object of the present invention to provide a detonation system which combines one or more auxiliary booster charges with a standard booster charge to effectively ignite a main charge.

It is another object of the present invention to provide a reliable means of initiating steady state detonation in the main charges of general purpose bombs.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes an explosive booster system which initiates steady state detonation in relatively insensitive explosives.

Figure 1:
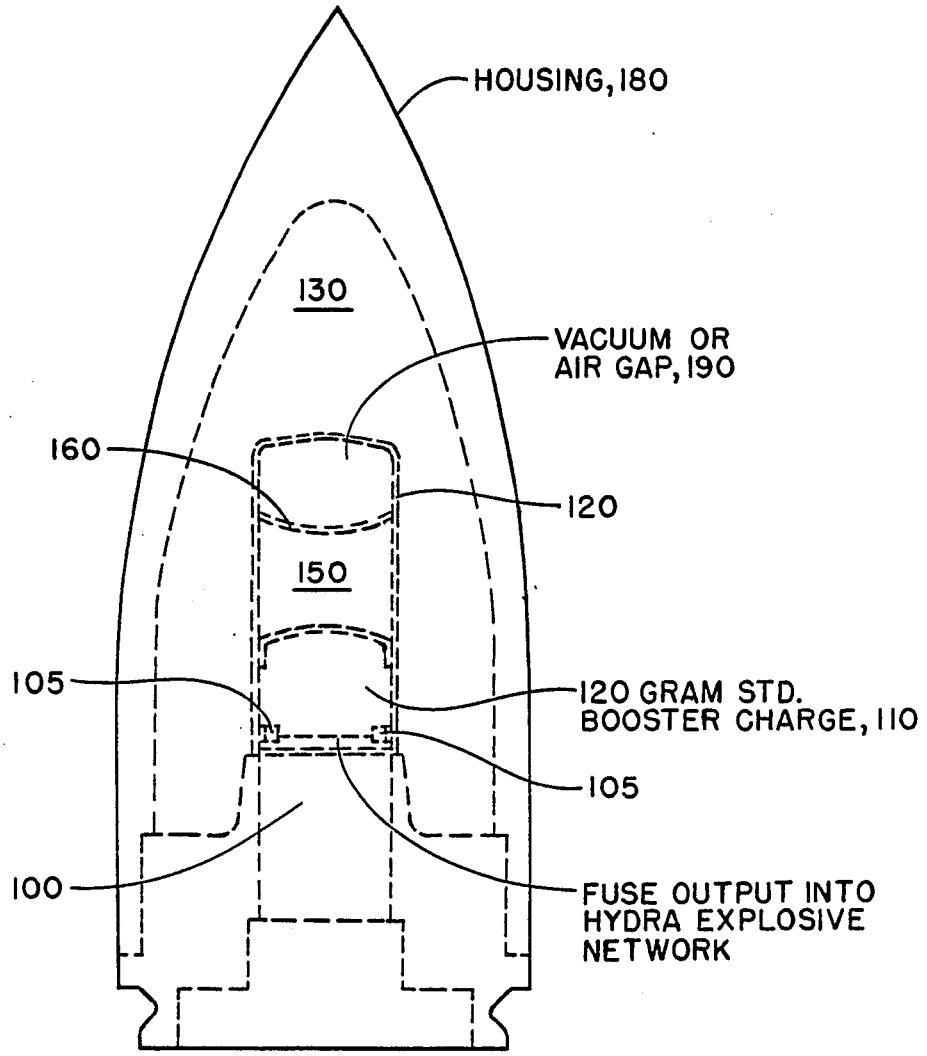
FIG. 1 is a mechanical schematic of the preferred embodiment of the present invention.

The reader's attention is now directed towards FIG. 1, which is a mechanical schematic depicting an embodiment of the present invention, as implemented in a Mark-82 series bomb.

The Mark-82 bomb normally uses a single ignition point to ignite a booster charge 110 which is housed in a fuse well 120. This booster charge is composed of a high energy explosive which, when detonated, is intended to ignite the main charge 130.

Currently the standard booster charge is composed of about 120 grams of a conventional high explosive substance, such as cyclotrimethylene trinitramine and similar substances. Experience has shown that this use of a single booster charge is insufficient to initiate a steady state detonation of the insensitive high explosive main charge 130.

The solution of the present invention is not simply to increase the standard booster charge, but to add one or more separate auxiliary boosters. In FIG. 1, a single auxiliary booster 150 is added to the fuse well 120 to enhance the ignition of the main charge 130. The auxiliary booster of FIG. 1 includes a tapered metal liner 160 which is positioned between the auxiliary booster charge and the end of the fuse well. This tapered metal liner 160 is designed to provide controlled packaging of the combined energy of the detonations of both the booster charge 110 and auxiliary booster charge 150 for initiation of the main charge. This design is discussed in detail below.

Figure 2:
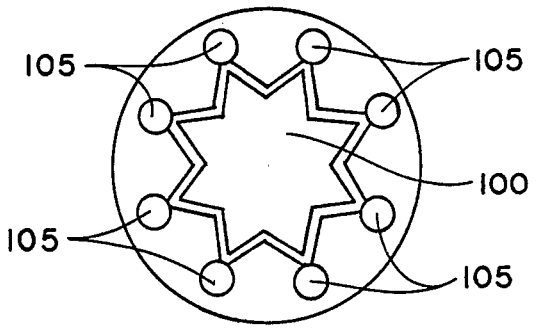
FIG. 2 is an end view of the proposed ignition system of a Mark-80 series bomb.

Operation of the present invention begins as the single ignition point detonates the explosive network 100. The ring of booster pellets 105 is subsequently simultaneously detonated. FIG. 2 is an end view of the hydra explosive network 100 which ignites a ring of eight booster pellets 105 to detonate the booster charge 110. These booster pellets are composed of high energy explosive compounds such as compounds A-4 and A-5.

Both A-4 and A-5 are variations of the high energy explosive known as RDX compound CH-6. RDX is cyclotrimethylene trinitramine, and A-4 and A-5 are variations of this compound with wax components added. The standard booster charge can be any high energy explosive, including RDX, A-4 or A-5.

The ignition of the standard booster charge 110 generates a planar detonation wave which ignites the auxiliary booster charge, so that it detonates as a second sequential event. The combined energy of both detonations is focused on the tapered metal liner 160 of the auxiliary booster. This tapered metal liner 160 is driven through the air gap into the end of the fuse well 190 of hypervelocity. The tapering of the metal liner 160 is designed such that the contact with the end of the fuse well is simultaneous, and occurs at a sufficiently high impact velocity to provide the desired pressure on the maximum amount of presented area at the end of the fuse well.

In the design of FIG. 1 the tapered metal liner is a lens-shaped flyer plate which is designed to provide controlled packaging of the detonation energy. Additional energy is provided by the generation of vaporific effects (jets of very hot metal particles) as the tapered liner 160 is driven into the metallic end of the fuse well. For enhanced vaporific action, the detonation system of the present invention includes the construction of both the tapered metal liner 160 and fuse well 190 from metal alloys with known pyrophoric characteristics, such as 80%/20% cerium aluminum alloys or zirconium.

The design of the present invention uses the acceleraton of pyrophoric metals to produce vaporic effects to enhance the detonation of insensitive high explosives. The main charge of the present invention can be tritonal, or any of the insensitive high explosives known in the art. Both the booster charge and the auxiliary booster charge can be constructed of materials selected from the high energy explosives. These high energy explosives certainly include cyclotrimethylene trinitramine (RDX compound) as well as variations of the formula (A-4 and A-5), or any of the nitroguanidine formulas such as AFX901 or EOP9015.

The auxiliary explosive and liner of the present invention can be easily fabricated so that it will interface with a standard 120 gram or 240 gram explosive booster and the end of the fuse well. An existing fuse of the conventional diameter may be used in Mark-80 series bombs modified by the present invention. The only requirements for the introduction of the new explosive system is the fabrication of a longer fuse well to accommodate the auxiliary assembly and provide the air gap.

The free space through which the explosively shaped tapered metal liner is projected at hypervelocity can be evacuated to improve maximum contact with the end of the fuse well and improve the efficiency of the system.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A detonation system, comprising:

a housing having a fuse well which has a front end and back end, and in which said front end of said fuse well is constructed of materials selected from a group containing cerium aluminum alloys and zirconium;

a main charge which is housed in said housing adjacent to said fuse well;

a booster charge which is housed in the back end of said fuse well, said booster charge being capable of detonation when ignited to produce a detonation wave;

a means for igniting said booster charge;

an auxiliary booster charge which is housed in said fuse well adjacent to said booster charge, said auxiliary booster charge being sequentially detonated by the detonation of said booster charge to ignite said main charge and initiate its detonation; and a flyer plate which is fixed in said fuse well between its front end and said auxiliary booster charge, said flyer plate being accelerated by the detonation of said auxiliary booster charge so that it strikes said front end with a high velocity and generates thereby vaporific effects which entail jets of very hot metal particles that enhance the detonation of the main charge, and wherein said flyer plate comprises a tapered metal liner which is fixed in said fuse well to said booster charge, said tapered metal liner being constructed of materials selected from a group containing cerium aluminum alloys and zirconium, said group having known pyrophoric characteristics which enhance the detonation of said main charge.

2. A detonation system, as defined in claim 1, in which said main charge is an insensitive high explosive and said booster charge and said auxiliary booster charge are high energy explosives.

3. A detonation system, as defined in claim 2, wherein said auxiliary booster charge is constructed of materials selected from a group containing cyclotrimethylene trinitramine and nitroguanidine.

4. A detonation system, as defined in claim 3, wherein said tapered metal liner is a lens-shaped structure which produces a flat plane wave as it strikes the back end of said fuse well.

5. A detonation system, as defined in claim 4, wherein said tapered metal liner is constructed of an alloy of about 80% cerium and about 20% aluminum.

6. A detonation system, as defined in claim 5, wherein said fuse well has a vacuum between said tapered metal liner and the front end of said fuse well.

* * * * *